US011684913B2

(12) United States Patent
Yi

(10) Patent No.: US 11,684,913 B2
(45) Date of Patent: Jun. 27, 2023

(54) TIGHT CONNECTION DEVICE FOR THE ASEPTIC TRANSFER OF A BIOPHARMACEUTICAL PRODUCT BETWEEN A CHAMBER AND A CONTAINER

(71) Applicant: SARTORIUS STEDIM FMT SAS, Aubagne (FR)

(72) Inventor: Shuai Yi, Guangdong (CN)

(73) Assignee: SARTORIUS STEDIM FMT SAS, Aubagne (FR)

( * ) Notice: Subject to any disclaimer, the term of this patent is extended or adjusted under 35 U.S.C. 154(b) by 489 days.

(21) Appl. No.: 16/651,171

(22) PCT Filed: Sep. 26, 2018

(86) PCT No.: PCT/FR2018/000223
§ 371 (c)(1),
(2) Date: Mar. 26, 2020

(87) PCT Pub. No.: WO2019/068963
PCT Pub. Date: Apr. 11, 2019

(65) Prior Publication Data

US 2020/0238273 A1 Jul. 30, 2020

(30) Foreign Application Priority Data

Oct. 3, 2017 (FR) ..... 1771042

(51) Int. Cl.
*B01L 1/02* (2006.01)
*A61J 1/20* (2006.01)

(52) U.S. Cl.
CPC ..... *B01L 1/02* (2013.01); *A61J 1/2093* (2013.01); *B01L 2200/025* (2013.01); (Continued)

(58) Field of Classification Search
None
See application file for complete search history.

(56) References Cited

U.S. PATENT DOCUMENTS 5,853,207 A 12/1998 Saint Martin et al.
2014/0150924 A1* 6/2014 Nodin ..... B01L 1/02 141/311 A
2016/0228870 A1* 8/2016 Clark ..... B01L 3/502

FOREIGN PATENT DOCUMENTS

CN 103826748 A 5/2014
CN 105518802 A 4/2016
(Continued)

OTHER PUBLICATIONS

Chinese Office Action (and English translation) for Chinese Patent Application No. 201880064529.6 dated May 26, 2021.
(Continued)

*Primary Examiner* — Matthew D Krcha
(74) *Attorney, Agent, or Firm* — Heslin Rothenberg Farley and Mesiti PC; Nicholas Mesiti

(57) ABSTRACT

A tight connection device for the aseptic transfer of a biopharmaceutical product includes: a stationary temporary clamping means keeping the container hermetically clamped against the chamber; a stationary unlocking means capable of switching the container from an initial locked position to an intermediate unlocked position; a stationary locking means; and an annular functional crown capable of being rotated to actuate the stationary unlocking means and the stationary locking means of the container. The stationary unlocking means and the stationary locking means are mechanically linked to the annular functional crown and arranged such that the rotation of the annular functional crown and the end locked position. The device further includes stationary immobilising/release means capable of allowing and preventing the annular functional crown to rotate.

20 Claims, 8 Drawing Sheets

(52) U.S. Cl.
CPC . *B01L 2200/0689* (2013.01); *B01L 2200/141* (2013.01); *B01L 2300/04* (2013.01); *B01L 2300/041* (2013.01); *B01L 2300/043* (2013.01); *B01L 2300/123* (2013.01)

(56) References Cited

FOREIGN PATENT DOCUMENTS

| | | | |
|---|---|---|---|
| EP | 2091051 | A1 | 8/2009 |
| FR | 2927464 | A1 | 8/2009 |
| FR | 2978362 | A1 | 2/2013 |
| FR | 3010118 | A1 | 3/2015 |
| IN | 398/DELNP/2014 | A | 2/2015 |
| IN | 531/DELNP/2014 | | 9/2015 |
| WO | 2016140920 | A1 | 9/2016 |

OTHER PUBLICATIONS

English translation of the Written Opinion of the International Searching Authority for International Application No. PCT/FR2018/000223 dated Nov. 7, 2018.
International Search Report (and English translation) and Written Opinion of the International Searching Authority for International Application No. PCT/FR2018/000223 dated Nov. 7, 2018.
French Search Report for French Application No. 1771042 dated Mar. 25, 2018.
English translation of Korean Office Action for Korean Patent Application No. 20207012698 dated Feb. 22, 2022.
First Examination Report issued in India Patent Application No. 202037018024 dated Mar. 11, 2020.

* cited by examiner

TIGHT CONNECTION DEVICE FOR THE ASEPTIC TRANSFER OF A BIOPHARMACEUTICAL PRODUCT BETWEEN A CHAMBER AND A CONTAINER

CROSS REFERENCE TO RELATED APPLICATIONS

This application is a national stage filing under section 371 of International Application No. PCT/FR2018/000223, filed on Sep. 26, 2018, published on Apr. 11, 2019 as WO 2019/068963 A1 which claims priority to French Patent Application No. 1771042, filed on Oct. 3, 2017. The entire disclosure of each application is hereby incorporated herein by reference.

The invention relates to the field of the aseptic transfer of biopharmaceutical products between a container and a closed chamber.

More specifically, the invention relates to, according to a first aspect, a tight connection device particularly intended to ensure the aseptic transfer of a biopharmaceutical product between a container and a closed chamber. The invention also relates to an assembly comprising such a tight connection device, a container and a closed chamber making it possible to ensure the aseptic transfer of biopharmaceutical products between the container and the closed chamber. The invention furthermore relates to, according to a third aspect, a method for aseptically transferring a biopharmaceutical product between the container and the closed chamber.

BACKGROUND

It must be understood here, by biopharmaceutical product or biopharmacy product, which relates to biotechnology, to pharmacy, and more generally to the medical field. In particular, a biopharmaceutical product is a product coming from biotechnology—culture environments, cell cultures, buffer solutions, artificial nutrition liquids—or a product intended to be used in the pharmaceutical or medical field, at least partially, in more or less finely divided solid form, in liquid form, or in paste form or also, more generally, a material product—plug, recipient, tube or integrated ports, syringe, syringe piston, functional processing or packaging means, assembly more or less complex comprising a plurality of products, etc.—intended to be used inside the closed chamber.

Conventionally, the term "container" mean which, in biopharmacy, is capable of and intended to, in the inner space thereof, contain, confine or enclose a certain biopharmaceutical content, or if necessary, several biopharmaceutical contents, more or less durably or lastingly static. Such a biopharmaceutical content is typically constituted by one or more biopharmaceutical product(s) such as defined above. Such containers can be rigid or flexible, single-use or actually reusable, of varied sizes and are, for example, pockets, sleeves, containers, recipients, bioreactors or also ducts for biopharmaceutical use, this list not being limiting.

In the field of the aseptic transfer of biopharmaceutical products, there is the need to make a container and a tight chamber communicate, in particular for transfers of biopharmaceutical products, without the sealing with respect to the outer environment of the container and/or of the chamber being broken and without leading to a contamination of the biopharmaceutical products.

To do this, document FR2978362 is known from the state of the art, which relates to a tight connection device, making it possible to ensure such an aseptic transfer. The device comprises stationary temporary clamping means, capable of holding the container against the chamber of the connection device. At least one magnet is also provided to engage the removable cover of the container against the door of the chamber during the aseptic transfer. The device also comprises stationary unlocking means, making it possible to switch the removable cover of the container from a position wherein it hermetically seals the container, to a position wherein it is disengaged from the container in order to ensure an aseptic communication between the container and the chamber. The device also comprises stationary locking means capable of switching the container into an end locking position wherein the removable cover again hermetically seals the container definitively. The stationary temporary clamping, unlocking and end locking means are connected to an annular functional crown such that the unidirectional rotation of the annular functional crown drives the actuation of the stationary temporary clamping means, then unlocking then end locking means.

Although this arrangement is absolutely satisfactory, this device makes the opening of the door of the chamber possible when a container having already used and in the end locking state is clamped there, in particular by breaking the attraction force of the magnet engaging the removable cover of the container on the door of the chamber. Once the door of the chamber is open, the non-sterile face of the door of the container is thus in contact with the atmosphere of the chamber, thus breaking the sterility of the latter.

In this context, the present invention improves the situation.

SUMMARY OF THE INVENTION

In this regard, the invention proposes a tight connection device intended to ensure the aseptic transfer of a biopharmaceutical product between a chamber equipped with a removable door and a container equipped with a removable cover, comprising:

- stationary temporary clamping means capable of holding the clamped container against the chamber, such that the removable cover of said container is hermetically pressed against the removable door of said chamber;
- stationary unlocking means capable of switching the container from an end locking position wherein the removable cover hermetically seals the container to an intermediate unlocking position wherein the removable cover is disengaged from the container and hermetically held against the removable door of the chamber so as to ensure an aseptic communication between said container and said chamber;
- stationary locking means capable of switching the container from the intermediate unlocking position to an end locking position wherein said removable cover again hermetically seals the container;
- an annular functional crown capable of being rotated about a geometric axis of rotation so as to actuate the stationary unlocking means and the stationary locking means of the container, said stationary unlocking means and said stationary locking means being mechanically linked to the annular functional crown and arranged such that the rotation of said annular functional crown about the geometric axis of rotation successively drives the actuation of the stationary unlocking means ensuring the switching into the intermediate unlocking position of the container, then the actuation of the stationary locking means ensuring the switching into the end locking position of the container, characterized in that the device further comprises stationary immobilizing/release means are in an immobilizing position, and capable of allowing a rotation of the annular functional crown when the stationary immobilizing/release means are in a release position.

The stationary immobilizing/release means prevent the opening of the door of the chamber without a container is clamped there and without a container already used is clamped there. This solution considerably reduces the risk of contamination of the tight connection device.

According to an embodiment, the device further comprises stationary opening/closing means capable of preventing/allowing the removable door of the chamber and mechanically linked to the annular functional crown such that the rotation of the annular functional crown about the geometric axis of rotation successively or simultaneously drives the actuation of the stationary unlocking means ensuring the switching into the intermediate unlocking position of the container and the actuation of the stationary opening/closing means ensuring the release of the removable door of the chamber, then the actuation of the stationary locking means of the container ensuring the switching into the end locking position of the container, then simultaneously or successively the actuation of the stationary opening/closing means ensuring the immobilization of the removable door of the chamber.

According to an embodiment, the stationary unlocking means comprise an unlocking push-button element with rotating movement and an unlocking member likely to be meshed by a portion of the annular functional crown forming gearing such that, during the rotation of the annular functional crown to an intermediate unlocking position, the push-button element being moved and switches the container from the initial locking position to the intermediate unlocking position.

According to an embodiment, the stationary locking means comprise a locking push-button element with rotating movement and a locking member likely to be meshed by a portion of the annular functional crown forming gearing such that, during the rotation of the annular functional crown to an end locking position, the push-button element is moved and switches the container from the intermediate unlocking position to the end locking position.

According to an embodiment, the stationary immobilizing/release means are capable of preventing the rotation of the push-button element of the stationary unlocking means, such that the container is not allowed to switch from the initial unlocking position to the intermediate unlocking position.

According to an embodiment, the stationary immobilizing/release means are capable of switching from an immobilizing position to a release position when the container is held clamped against the chamber, by means of embedded immobilizing/release means arranged on the container.

According to an embodiment, the stationary immobilizing/release means comprise a finger, mounted mobile in a channel extending in a transversal direction to a radial direction, the finger being capable of being urged by a spring towards a deployed position wherein the finger exceeds outside of the tight connection device, the stationary immobilizing/release means being in an immobilizing position, the stationary immobilizing/release means thus being in a release position.

According to an embodiment, the stationary temporary clamping means comprise a clamping element capable of rotating about a clamping axis of rotation, such that, during the rotation of the annular functional crown to an initial locking position, the clamping element being moved and hermetically holds the container against the removable door of the chamber.

According to an embodiment, the stationary temporary clamping means comprise a clamping element capable of rotating about a clamping axis of rotation, such that, during the activation of a lever driving a rotation of a protective crown, the clamping element is moved and hermetically holds the container against the removable door of the chamber.

According to an embodiment, the stationary opening/closing means are directly mechanically connected to the unlocking push-button element.

According to an embodiment, the device further comprises stationary moving means of the removable door of the chamber capable of opening and of hermetically closing the removable door of the chamber.

According to an embodiment, the stationary moving means of the removable door of the chamber, such that the door does not impede the switching of the biopharmaceutical product.

According to an embodiment, the annular functional crown is rotated by means of a lever.

According to an embodiment, there are at least 2, preferably 3, preferably 4 stationary locking means, as well as stationary unlocking means.

According to an embodiment, the stationary locking means and the stationary unlocking means are structurally combined.

The invention is also based on an assembly comprising a chamber and a tight connection device particularly intended to be associated with a single-use type container equipped with a removable cover in view of carrying out the aseptic transfer of a biopharmaceutical product between the chamber and the container, wherein the chamber comprises a peripheral closed wall wherein is arranged an annular opening hermetically sealed by a removable door and wherein the tight connection device is produced according to the invention, the assembly further comprising a single-use type container equipped with a removable cover.

According to an embodiment, the single-use type container is particularly intended to ensure the transport and the aseptic transfer of a product belonging to the biopharmaceutical field and comprises:

- an annular flange delimiting an annular opening;
- a removable cover capable of hermetically sealing the opening of the annular flange;
- embedded immobilizing/release means of the annular functional crown;
- embedded locking/unlocking means of the removable cover on the annular flange; and
- a peripheral casing integral with the annular flange and delimiting a confined inner space capable of receiving the products belonging to the biopharmaceutical field;

wherein the embedded immobilizing/release means comprise at least one embedded functional immobilizing/release arrangement formed, on the one hand, by a through housing formed in the annular flange and a blind housing formed in the removable cover and in the extension of the through housing when the removable cover hermetically seals the opening of the annular flange and, on the other hand, by an inner radial positioning pin and an outer radial positioning pin likely to be introduced and being moved inside the blind housing of the removable cover and of the through housing of the annular flange; and wherein the embedded locking/unlocking means comprise at least one embedded functional locking/unlocking arrangement formed, on the one hand, by a through housing formed in the annular flange and a blind housing formed in the removable cover and in the extension of the through housing when the removable cover hermetically seals the opening of the annular flange and, on the other hand, by an inner radial positioning pin and an outer radial positioning pin likely to be introduced and being moved inside the blind housing of the removable cover and of the through housing of the annular flange;

the container being capable of being located in an initial locking position wherein, on the one hand, the inner radial positioning pin has an inner locking functional portion arranged in the blind housing of the removable cover and an outer locking functional portion arranged in the through housing of the annular flange so as to prevent the relative movement of the removable cover with respect to the annular flange and, on the other hand, the outer radial positioning pin is at least partially arranged in the through housing of the annular flange, such that at least one initial outer functional locking portion of the outer radial positioning pin exceeds outside of the through housing;

the container being capable of being located in an intermediate unlocking position wherein, on the one hand, the inner radial positioning pin is at least partially arranged in the blind housing of the removable cover and fully excluded from the through housing of the annular flange and, on the other hand, the outer radial positioning pin is at least partially arranged in the through housing of the annular flange and fully excluded from the blind housing of the removable cover so as to allow the relative movement of the removable cover with respect to the annular flange;

the container being capable of being located in an end locking position wherein, on the one hand, the inner radial positioning pin is arranged in the blind housing of the removable cover and, on the other hand, the outer radial positioning pin has an end inner functional locking portion arranged in the blind housing of the removable cover and an end outer functional locking portion arranged in the through housing of the annular flange so as to prevent the relative movement of the removable cover with respect to the annular flange.

The invention also aims for an aseptic transfer method intended to ensure the aseptic transfer of a biopharmaceutical product between a container and a chamber belonging to an assembly according to the invention, characterized in that it comprises successive steps consisting of:

- arranging the chamber, of the tight connection device and of the container;
- positioning the container against the peripheral wall of the chamber by affixing the annular flange against the peripheral wall of the chamber, such that the stationary immobilizing/release means, and the embedded immobilizing/release means are face-to-face;
- generating the clamping of the annular flange of the container with respect to the peripheral wall of the chamber;
- switching the stationary immobilizing/release means from an immobilizing position to a release position;
- generating the switching of the container from the initial locking position to the intermediate unlocking position by rotation of the annular functional crown;
- simultaneously opening the removable door of the chamber and the removable cover of the container, the removable cover being hermetically fixed against the removable door;
- aseptically transferring one or more biopharmaceutical products between the container and the chamber;
- simultaneously closing the removable door of the chamber and the removable cover of the container, the removable cover being hermetically fixed against the removable door;
- generating the switching of the container from the intermediate unlocking position to the end locking position by rotation of the annular functional crown;
- generating the unclamping of the annular flange of the container with respect to the peripheral wall of the chamber;
- switching the stationary immobilizing/release means from a release position to an immobilizing position.

BRIEF DESCRIPTION OF THE DRAWINGS

Other features and advantages of the invention will emerge from the description made of it below, in reference to the drawings, wherein:

FIGS. 4*a* to 4*c* are top views of the tight connection device of the preceding figures, with no protective crown, associated with the container according to the invention, wherein FIG. 4*a* illustrates a tight connection device and a container in the initial locking position, FIG. 4*b* illustrates a tight connection device and a container in the intermediate unlocking position, and FIG. 4*c* illustrates a tight connection device and a container in the end locking position;

DETAILED DESCRIPTION

Below, a detailed description of several embodiments of the invention accompanied by examples and reference to the drawings.

Figure 1:
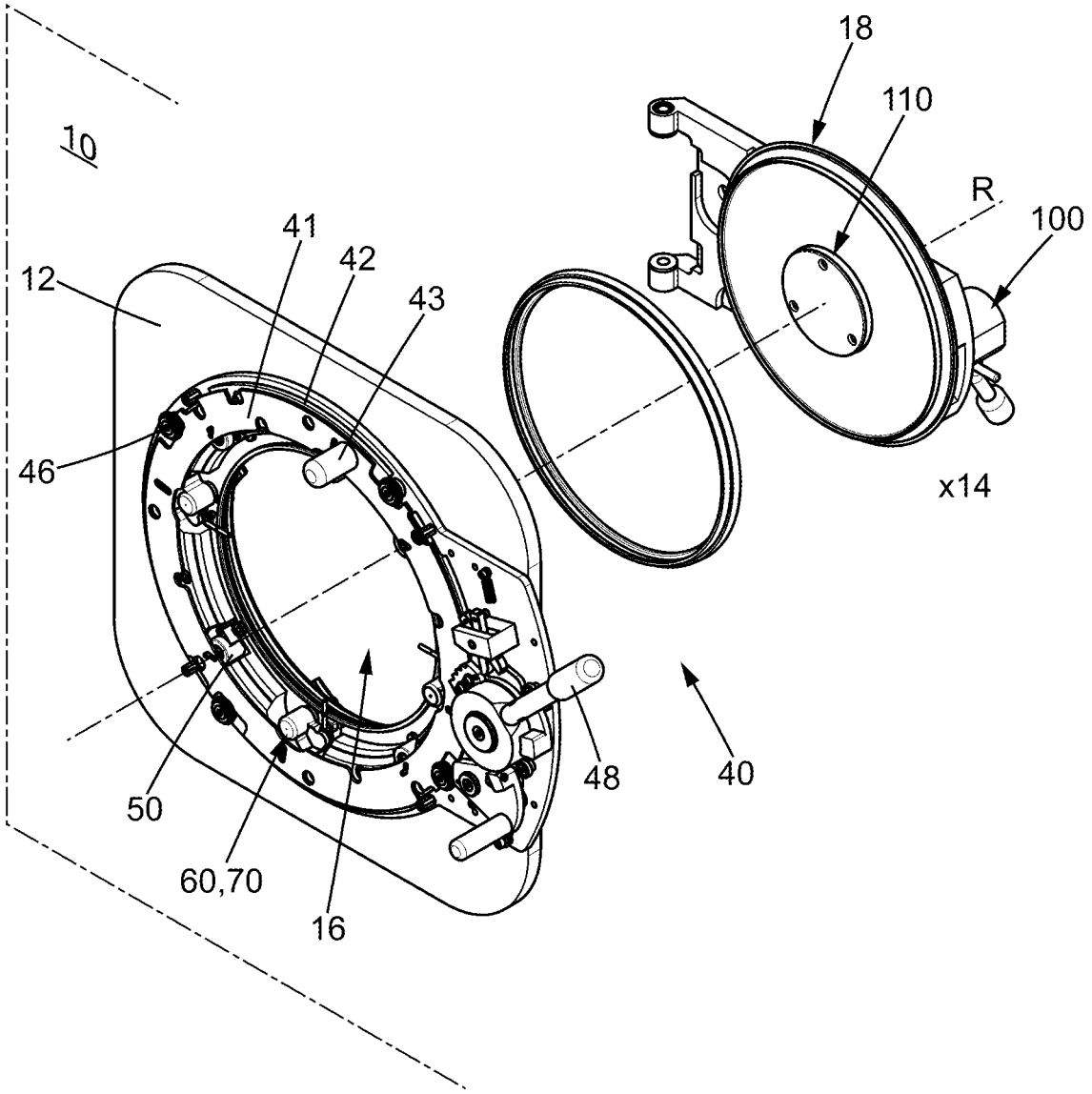
FIG. 1 is an overview, a perspective view and an exploded view, of a tight connection device associated with the peripheral wall of a chamber.

FIG. 1 represents a closed chamber 10 comprising a peripheral wall 12 defining a confined inner space 14 and a circular opening 16 allowing the introduction of biopharmaceutical products (not represented) in the confined inner space 14.

The chamber 10—which can be a premises or any other similar installation—is designed to be permanently isolated from the outer environment. Thus, to avoid any loss of integrity and to conserve an aseptic environment in the inner space 14, the annular opening 16 is hermetically sealed by a removable door 18 positioned in the inner space and capable of switching from a closed position wherein the circular opening 16 is blocked to an open position wherein the circular opening 16 is no longer blocked.

Conventionally, the terms "inner" and "outer" qualify, below in the description, the relative positions of objects with respect to the geometric axis of the annular opening 16. Thus, the object qualified as "inner" or having an "inner radial positioning" must be considered as placed as close as possible to the geometric axis of the annular opening 16 while the object qualified as "outer" or having an "outer radial positioning" must, comparatively, be considered as placed as far as possible from the geometric axis of the annular opening 16.

Figure 2A:
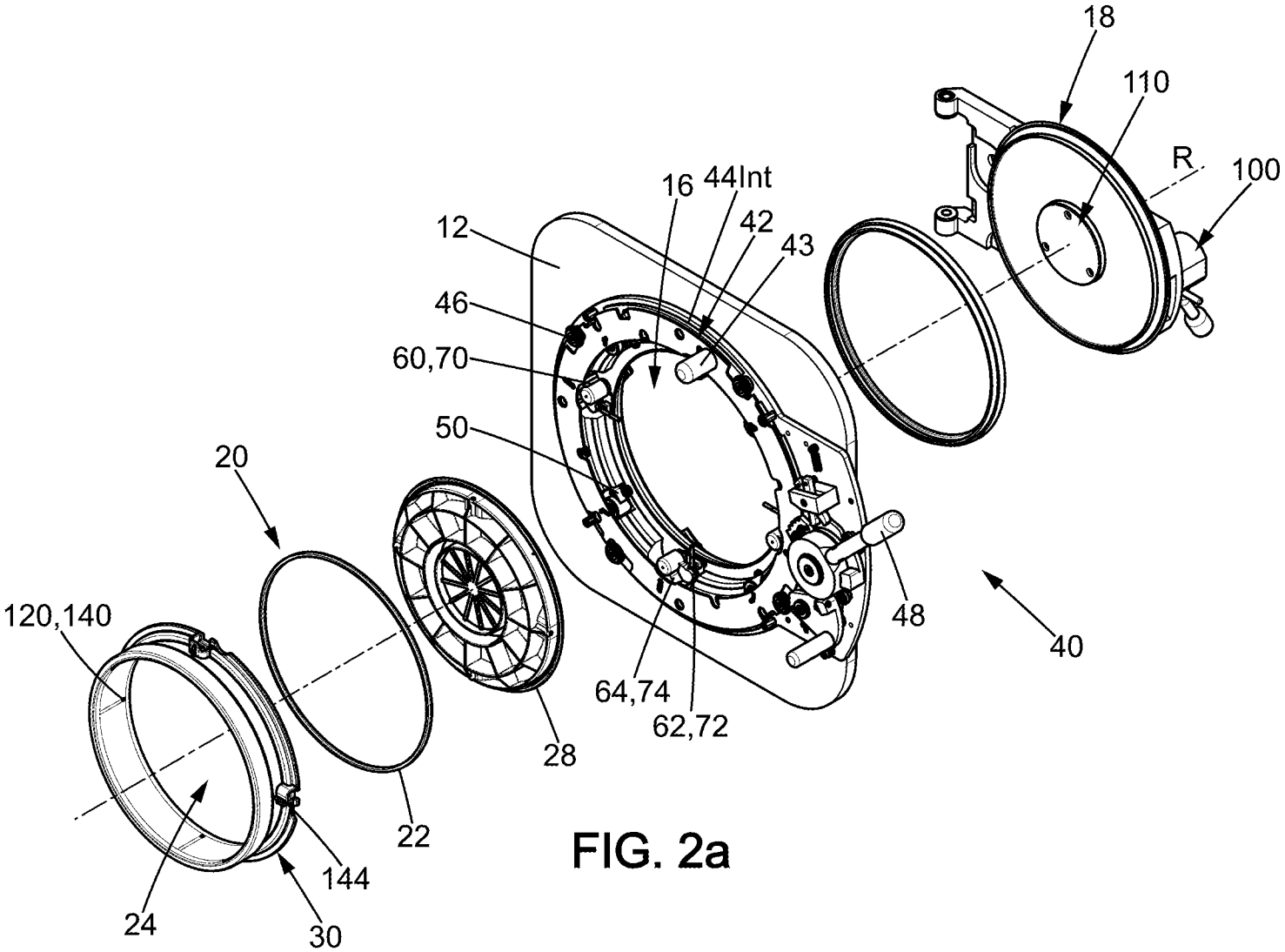
FIGS. 2*a* and 2*b* are two overviews, a perspective view and an exploded view, from the outside of the chamber and from the inside of the chamber, of a tight connection device of FIG. 1 installed on a portion of the peripheral wall of the chamber and ready to be associated with the annular flange of a container according to the invention.
Figure 2B:
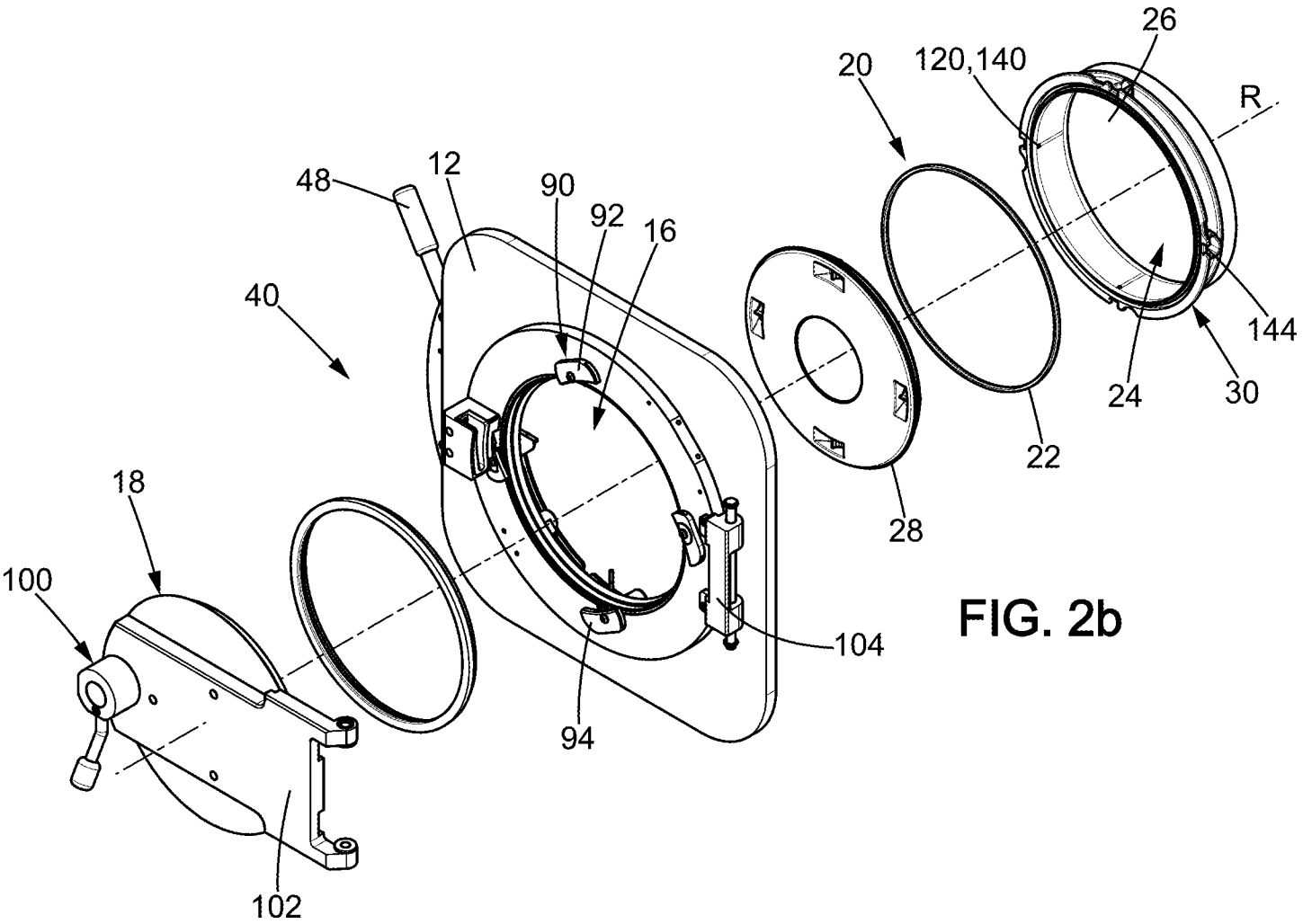

FIGS. 2*a* and 2*b* represent a container 20 intended to transport biopharmaceutical products and ready to be associated with the closed chamber 10 to carry out an aseptic transfer of biopharmaceutical products to or from this chamber 10.

The container 20 comprises, in this regard, a peripheral casing (not represented) defining a confined inner space 24, wherein the biopharmaceutical products can be introduced. The peripheral casing also comprises an annular opening 26 delimited by an annular flange 30 on which the peripheral casing is integrally fixed. The container 20 further comprises a removable cover 28 capable of hermetically sealing the opening 24 of the annular flange 30 by resting on a seal 22.

The container 20 can be produced according to different embodiments and, in this regard, have a flexible peripheral casing and intended for single-use or rigid and intended to be reused after a decontamination procedure well-known to a person skilled in the art.

In reference to FIGS. 1, 2*a* and 2*b*, a tight connection device 40 is described, intended to make it possible for the aseptic transfer of biopharmaceutical products coming from the container 20 (subsequently described) to the chamber 10.

The tight connection device 40 therefore aims, first, to make it possible for the assembly of the chamber 10 and of the container 20, then, to allow the putting into temporary communication of the inner space 14 of this chamber 10 with the inner space of the container 20 to ensure the transfer of biopharmaceutical products from one to the other and, finally, to ensure the separation of said chamber 10 and of said container 20.

These successive steps—subsequently comprised under the qualification of "aseptic transfer"—must be carried out without there being any communication between the outer environment, on the one hand, and the inner spaces 14, 24 of the chamber 10 and of the container 20, on the other hand.

To do this, the tight connection device 40 according to the embodiment of FIG. 1, has a portion formed outside of the chamber 10 and supported by the peripheral wall 12—or by a support part separate from the peripheral wall 12, but fixedly clamped on it—facing the annular opening 16. More specifically, the tight connection device 40 comprises an annular functional crown 42.

The annular functional crown 42 has an inner peripheral perimeter $\mathbf{44}_{INT}$ and an outer peripheral perimeter $\mathbf{44}_{EXT}$ entered inside four carrier ball bearings 46 themselves supported by the outer face of the peripheral wall 12. In this manner, the annular functional crown 42 is positioned outside of the chamber 10, which facilitates possible maintenance operations. The four carrier ball bearings 46 form a support for the annular functional crown and ensure the rotation thereof about the geometric axis of the annular opening 16. However, it must be underlined that the holding in position of the annular functional crown could be ensured by any other similar mechanical element (roller, bearing, etc.).

According to the embodiment example of FIG. 1, the annular functional crown 42 which has several portions having separate mechanical functions (subsequently described) can be made of one single holding—by machining, molding, or similar—from one sole and single material block. This embodiment has the advantage of simplifying the production of the annular functional crown, of decreasing, at the same time, the production costs and ensuring an optimal positioning of the functional surfaces of the annular functional crown 42. However, it is understood that the annular functional crown could also, according to other embodiments, be formed from a plurality of separate mechanical parts, assembled to one another by one single holding such that the rotation of one of these mechanical parts about the geometric axis of rotation R between the rotation of all of them together.

In reference to FIG. 1, a protective crown 41 can also be provided, affixed on the annular functional crown, such that the annular functional crown 42 is not accessible.

It must be highlighted that, conventionally, the objects called "stationary" form part of the tight connection device 40 and are therefore intended to be linked and fixedly clamped onto the chamber 10. Conversely, the objects called "embedded" are intended to be supported by the containers 20 and are therefore mobile with the latter.

The annular functional crown 42, is capable of entering into rotation about the geometric axis of rotation R under the action of a lever 48, for example manually activated. In a variant, the annular functional crown can be rotated by means of a motor.

According to an embodiment, the protective crown 41 is also capable of entering into rotation about the geometric axis of rotation 2 under the action of a lever 43, for example manually activated by a user.

The tight connection device 40 comprises stationary temporary clamping means 50.

The stationary temporary clamping means 50 have the function of holding the container 20 clamped against the chamber 10 such that the removable cover 28 of this container 20 are hermetically pressed against the removable door 18 of the chamber 10.

The stationary temporary clamping means 50 are, according to a first embodiment, mechanically linked to the annular functional crown 42 such that the rotation of the annular functional crown 42 about the geometric axis of rotation R mechanically drives the actuation of the stationary temporary clamping means 50.

According to a second embodiment, the stationary temporary clamping means 50 are mechanically linked to the protective crown 41 such that the rotation of the protective crown 41 about the geometric axis of rotation R mechanically drives the actuation of the stationary temporary clamping means 50.

Below in the description, and as a non-limiting example, it is considered that the stationary temporary clamping means 50 are mechanically driven by the rotation of the annular functional crown 42.

According to the embodiment of FIG. 1, there can be four stationary temporary clamping means 50, regularly distributed around the annular functional crown 42. The stationary temporary clamping means 50 are formed by a clamping element 52, capable of rotating about an axis of clamping rotation so as to temporarily clamp the removable cover 28 of the container 20 against the removable door 18 of the chamber 10.

More specifically, the clamping element 52, after rotation, radially exceeds in the annular opening 16 and abuts against the container 20 so as to prevent a disengagement of the removable cover 28 and of the removable door 18.

The tight connection device 40 comprises stationary unlocking means 60.

The stationary unlocking means 60 are intended to switch the container 20 from an initial locking position wherein the removable cover 28 hermetically seals the container 20 to an intermediate unlocking position, wherein the removable cover 28 is disengaged from the container and hermetically held against the door 18 of the chamber 10 so as to ensure an aseptic communication between the container 20 and the chamber 10.

These stationary unlocking means 60 are mechanically linked to the annular functional crown 42 such that the rotation of the annular functional crown 42 about the geometric axis of rotation R mechanically drives the actuation of the stationary unlocking means 60.

According to the embodiment of FIG. 1, the tight connection device comprises four stationary unlocking means 60, although it can comprise less than four of them, or more than four. The stationary unlocking means are regularly distributed about the annular functional crown 42.

Each of the stationary unlocking means comprises a locking push-button element 62 with rotating movement and an unlocking drive member 64 likely to be meshed by a portion of the annular functional crown 42 forming gearing such that, during the rotation of the annular functional crown 42 to an intermediate unlocking position, the unlocking push-button element 62, under meshing of the unlocking drive member 64, is moved about the axis of rotation thereof and switches the container from the initial locking position to the intermediate unlocking position.

More specifically, during the rotation of the annular functional crown 42 to an intermediate unlocking position, the relative movement of the annular functional crown 42 with respect to the push-button element causes the movement of the drive member 64 by means of the portion forming gearing. In the intermediate unlocking position, the push-button element 62 radially exceeds, for example, into the circular opening 16 of the chamber.

The tight connection device 40 comprises stationary locking means 70.

The stationary locking means 70 are intended to switch the container 20 from the intermediate unlocking position to an end locking position wherein said removable cover 28 seals, again, the container 20 hermetically.

As above, these stationary locking means 70 are mechanically linked to the annular functional crown 42 such that the rotation of this annular functional crown 42 about the geometric axis of rotation R mechanically drives the actuation of the stationary locking means 70. In the same manner as above, the relative position of the stationary locking means 70 and stationary unlocking means 60 about the annular functional crown 42 is such that the actuation of these stationary locking means 70 can only be consecutive to the stopping of the stationary unlocking means 60.

Figure 4A:
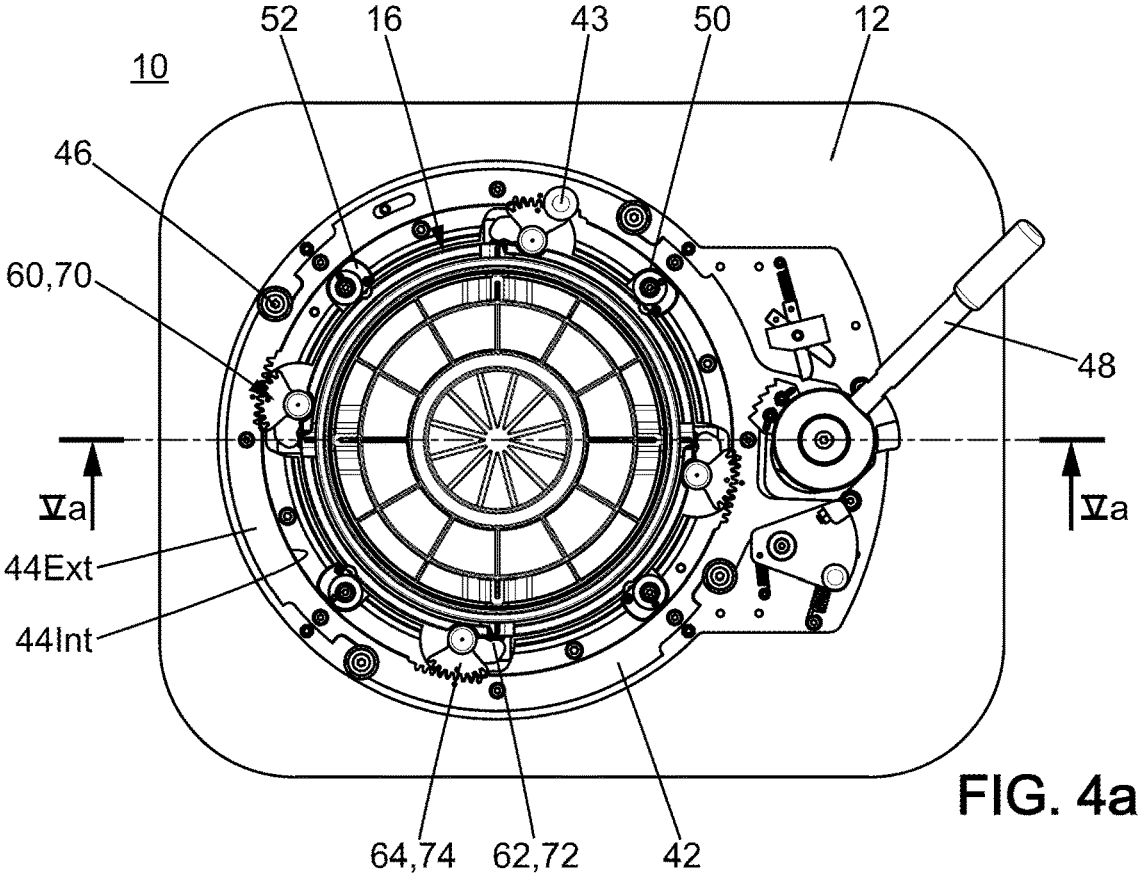
Figure 4B:
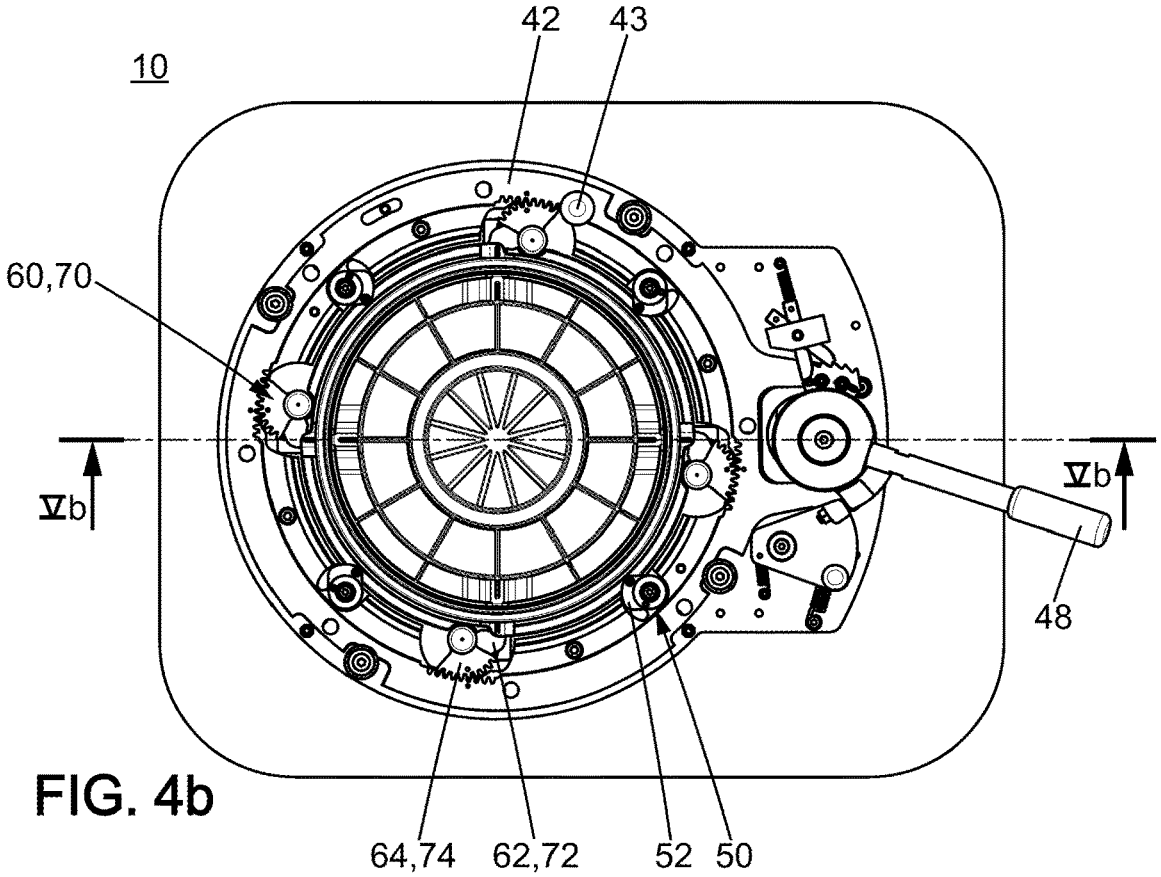
Figure 4C:
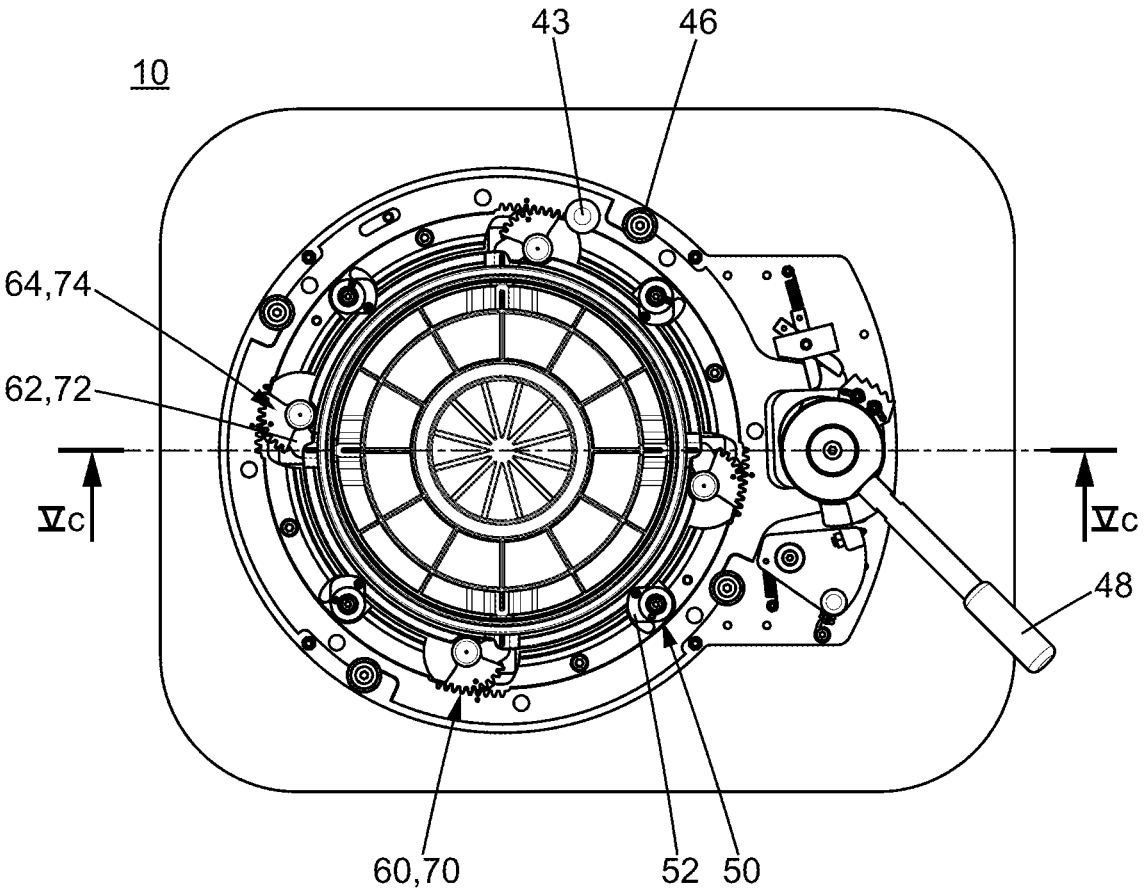

According to the embodiment of FIGS. 4*a* to 4*c*, the tight connection device comprises four stationary locking means, although it can comprise less than four of them, or more than four. The stationary locking means 70 are regularly distributed about the annular functional crown 42.

Each of the stationary locking means 70 comprises a locking push-button element 72 with rotating movement and a locking drive member 74 likely to be meshed by a portion of the annular functional crown 42 forming gearing such that, during the rotation of the annular functional crown 42 to an end locking position, the locking push-button element 72, under meshing of the locking drive member 74, is moved about the axis of rotation thereof and switches the container from the intermediate unlocking position to the end locking position.

More specifically, during the rotation of the annular functional crown 42 to an end locking position, the relative movement of the annular functional crown 42 with respect to the push-button element causes the movement of the drive member 74 by means of the gearing-forming portion. In the end locking position, the push-button element 72 radially exceeds, for example, into the circular opening 16 of the chamber.

According to an illustrative and non-limiting embodiment of FIG. 1, the stationary unlocking means 60 and the stationary locking means 70 are structurally combined with one another. More specifically, the push-button elements 62 and 72 are combined, as well as the drive members 64 and 74.

Conversely, according to an alternative (not represented), the stationary unlocking means 60 and the stationary locking means 70 could possibly be structurally separate and independent from one another.

The tight connection device 40 comprises stationary immobilizing/release means 80.

The stationary immobilizing/release means 80 are capable of switching the annular functional crown from an immobilizing position wherein the annular functional crown is not capable of being rotated, to a release position wherein the annular functional crown 42 is capable of being rotated.

More specifically, the stationary immobilizing/release means 80 are capable of preventing the movement of the push-button elements 62 of the stationary unlocking means 60, such that the tight connection device 40 is not allowed to switch from the initial locking position to the intermediate unlocking position.

According to the embodiment of FIGS. 4*a* to 4*c*, the tight connection device comprises four stationary immobilizing/release means 80, although it can comprise less than four of them, or more than four. The stationary immobilizing/release means 80 are regularly distributed around the annular functional crown 42.

The relative position of the stationary immobilizing/release means 80 and of the stationary unlocking means 60 around the annular functional crown 42 is such that the actuation of these stationary unlocking means 60 can only be consecutive to the actuation of the stationary immobilizing/release means 80.

More specifically, the stationary immobilizing/release means 80 are actuated by the clamping of the container 20 against the chamber 10 by the embedded immobilizing/release means 140 of the container 20, such as described below.

The stationary immobilizing/release means comprise a finger 82, mounted mobile in a channel 84. The channel 84 extends in a transversal direction to the radial direction such that the channel 84 is, for example, parallel to the axis of rotation R. The finger 82 is urged by a spring 86 to a deployed position, wherein the finger exceeds outside of the tight connection device 40, such that the push-button element 62 abuts against the finger 82. The finger 82 can be moved against the urging of the spring 86 into a retracted position wherein the finger 82 does not exceed outside of the tight connection device, such that the push-button element 62 can be moved and thus allow the rotation of the annular functional crown about the axis of rotation R thereof.

The tight connection device 40 comprises stationary opening means 90.

These stationary opening means 90 are intended to prevent/allow the opening of the removable door 18 of the chamber 10 and are mechanically linked to the annular functional crown 42 such that the rotation of this annular functional crown 42 about the geometric axis of rotation R mechanically drives the actuation of the stationary opening means 90. More specifically, due to the position of these stationary opening means 90 on the annular functional crown 42, the latter ensure the opening of the removable door 18 of the chamber 10.

According to the embodiment of FIG. 2*b*, the stationary opening means 90 ensure the opening of the removable door 18 after the actuation of the stationary unlocking means 60 have led to switching the container 20 into the intermediate unlocking position. In this manner, the opening of the removable door 18 of the chamber 10 is delayed when a problem occurs during the intermediate unlocking of the container 20. This makes it possible to limit the confinement problems necessarily more complex to repair within the chamber 10 which could result from an error in handling the container 20. Similarly, these stationary opening means 90 are arranged on the annular functional crown 42 in order to ensure the closing of the removable door 18 of the chamber 10 before the stationary locking means 70 had been activated to switch the container 20 into the end locking position.

The stationary opening means 90 are, for example, connected to the stationary unlocking means 60. Thus, the movement of said stationary unlocking means to an intermediate unlocking position drives a movement of the stationary opening means 90 in a position wherein the stationary opening means 90 allow the opening of the removable door 18.

Likewise, the stationary opening means 90 are, for example, connected to the stationary locking means 70. Thus, the movement of said stationary locking means to an end locking position drives a movement of the stationary opening means 90 in a position wherein the stationary opening means 90 prevent the opening of the removable door 18.

The stationary opening means 90 can be arranged such that the latter allow the release of the removable door 18 simultaneously to the switching of the container 20 into the intermediate unlocking position, then the immobilization of this removable door 18 simultaneously to the switching of the container 20 into the end locking position.

It can also be considered to arrange the stationary opening means 90 such that the latter allow, on the one hand, the release of the removable door 18 of the chamber 10 before the switching of the container 20 into the intermediate unlocking position and, on the other hand, the immobilization of the removable door 18 of the chamber 10 after the switching of the container 20 into the end locking position.

The stationary opening means 90, such as illustrated in FIG. 2*b*, comprise, for example, a functional opening rod 92 situated in the axis of the axis of rotation of the stationary means 60, 70. The functional rod 92 connects, for example, the stationary means 60, 70 to a body 94 situated inside the inner space 14, preventing the opening of the removable door by overlapping said removable door in the direction of the opening.

The tight connection device 40 also comprises stationary moving means 100.

These stationary moving means 100 are intended to hermetically open and close the removable door 18 of the chamber 10.

To do this, the stationary moving means 100 can, according to a first embodiment, be mechanically driven by the annular functional crown 42. In this scenario, the stationary moving means 100 are mechanically linked to the annular functional crown 42 such that the rotation of this annular functional crown 42 about the geometric axis of rotation R mechanically drives the actuation of the stationary moving means 100. More specifically, the position of these stationary moving means 100 on the annular functional crown 42 makes it possible to open the removable door 18 of the chamber 10 after the switching of the container 20 into the unlocking position, then closing the removable door 18 before the switching of the container 20 into the end locking position.

In a variant, the stationary moving means 100 are driven by a moving motor (not represented) subjugated on the movement of the annular functional crown 42.

The stationary moving means 100 comprise a rotating arm 102 capable of being rotated about an axis of rotation of a hinge 104. In this manner, the stationary moving means 100 make it possible, thanks to the moving motor, to move the removable door 18 of the chamber 10, in a direction substantially perpendicular to the axial direction such that the removable door 18 does not impede the switching of the biopharmaceutical product during the aseptic transfer thereof between the chamber 10 and the container 20.

It must be noted that, according to a first embodiment, the stationary clamping means 50, the stationary unlocking means 60, the stationary locking means 70, the opening means 90 and the moving means 100 are mechanically linked to the annular functional crown 42 and arranged such that the rotation of said annular functional crown 42 about the geometric axis of rotation R successively drives the actuation of the stationary temporary clamping means 50 to ensure the holding in position of the container 20 against the chamber 10, then successively or simultaneously, the actuation of the stationary unlocking means 60 ensuring the switching into the intermediate unlocking position of the container 20 and the actuation of the stationary opening means 90 ensuring the release of the removable door 18 of the chamber 10. The actuation of the stationary unlocking means 60 is only consecutive to the actuation of the stationary immobilizing/release means 80. Then, the rotation of the annular functional crown 42 about the geometric axis of rotation R simultaneously or successively drives the actuation of the stationary opening means 90 ensuring the immobilization of the removable door 18 of the chamber 10 and the actuation of the stationary locking means 70 ensuring the switching into the end locking position of the container 20, and again the actuation of the stationary temporary clamping means 50 of the container in order to release the container 20.

According to a second embodiment, the stationary clamping means 50 are mechanically linked to the protective crown 41 and arranged such that the rotation of the protective crown 41 about the geometric axis of rotation R drives the actuation of the stationary temporary clamping means 50 to ensure the holding in position of the container 20 against the chamber 10. The stationary unlocking means 60, the stationary locking means 70, the opening means 90 and the moving means 100 are mechanically linked to the annular functional crown 42 and arranged such that the rotation of said annular functional crown 42 about the geometric axis of rotation R successively drives the actuation of the stationary unlocking means 60 ensuring the switching into the intermediate unlocking position of the container 20 and the actuation of the stationary opening means 90 ensuring the release of the removable door 18 of the chamber 10. The actuation of the stationary unlocking means 60 is only consecutive to the actuation of the stationary immobilizing/release means 80. Then, the rotation of the annular functional crown 42 about the geometric axis of rotation R simultaneously or successively drives the actuation of the stationary opening means 90 ensuring the immobilization of the removable door 18 of the chamber 10 and the actuation of the stationary locking means 70 ensuring the switching into the end locking position of the container 20. Finally, the actuation of the protective crown 41 again makes it possible for the actuation of the stationary temporary clamping means 50 of the container in order to release the container 20.

Stationary positioning elements 110 engaging with embedded positioning elements arranged on the container can also be provided, so as to ensure the positioning of the container against the chamber. These stationary positioning element ensure, in particular, the positioning of the embedded immobilizing/release means 140 facing the stationary immobilizing/release means 80.

The stationary positioning elements 110 can be magnets.

It must be highlighted that the rotation of the annular functional crown 42 makes it possible to ensure the actuation of the stationary unlocking, locking, opening and moving means that this annular functional crown is moved in a direction of rotation or in the other.

Furthermore, it would also be possible to integrate this annular functional crown 42 not outside of the chamber 10 as illustrated by the embodiment of FIG. 1, but directly in the inner space 14 of the chamber 10, against the inner face of the peripheral wall 12. This embodiment would make it possible, in particular, to avoid the use of opening means 90 having a functional rod 92 passing through the peripheral wall 12.

Figure 3A:
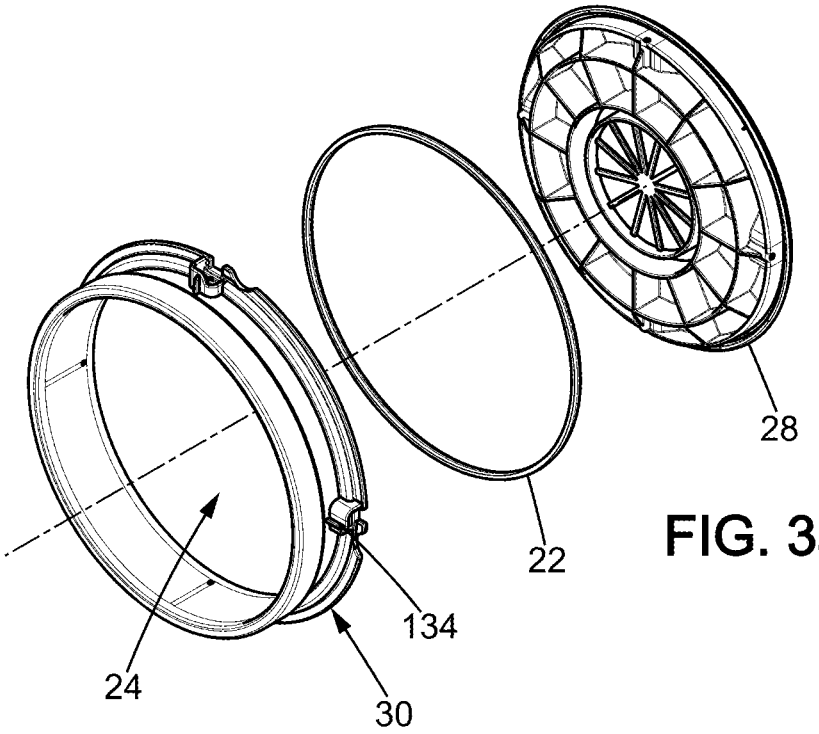
FIGS. 3*a* and 3*b* are two perspective views of the container according to the invention, respectively as an exploded view and as an overview.
Figure 3B:
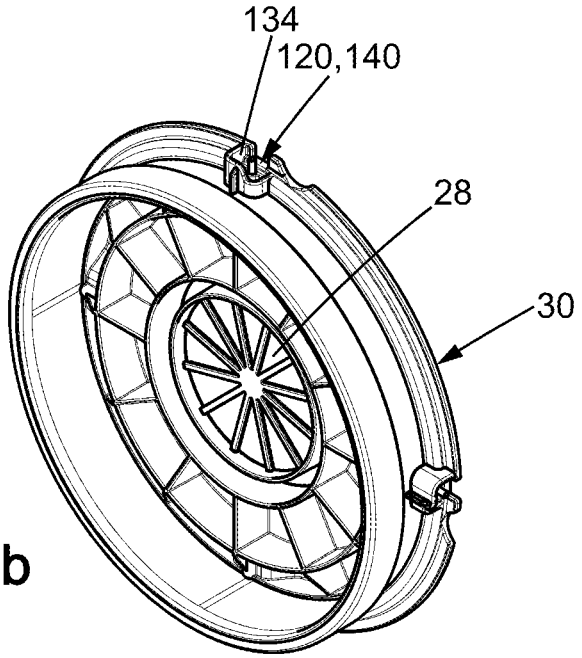

FIGS. 3*a* and 3*b* represent, in a more detailed manner, an embodiment of a container 20 intended to be associated with the tight connection device 40 according to the invention.

However, in this illustration, the peripheral casing of the container 20 is not represented.

As indicated above, this container 20 is intended to make it possible for the transport and the aseptic transfer of biopharmaceutical products from or to a chamber 10 equipped with the tight connection device 40 according to the invention.

In this regard, the container 20 comprises the annular flange 30 delimiting the annular opening 26, the removable cover 28 capable of hermetically sealing the opening 26 of the annular flange 30 and the peripheral casing integral with the annular flange 30 and delimiting the confined inner space 24 likely to contain the biopharmaceutical products. In this manner, when it is closed by the removable cover 28, the container 20 is hermetically closed, which prevents any leakage or any introduction of material in the inner space 24. The container 20 can be rigid or flexible and reusable or single-use according to the scenarios. As an illustration, and not at all limiting, it can be a container 20 of any size, such as a pocket, a sleeve, a recipient, a bioreactor, a duct, etc.

The container 20 comprises embedded immobilizing/release means 140.

The embedded immobilizing/release means 140 comprise at least one embedded functional immobilizing/release arrangement 142 formed, on the one hand, by a through housing 144 formed in the annular flange 30 and a blind housing 146 formed in the removable cover 28 and in the extension of the through housing 144 when the removable cover 28 hermetically seals the opening of the annular flange 30 and, on the other hand, by an inner radial positioning pin 148 and an outer radial positioning pin 150, comprising an outer radial positioning functional extreme portion 152, likely to be introduced and to be moved inside the blind housing 146 of the removable cover and of the through housing 144 of the annular flange 30.

The embedded immobilizing/release means 140 engage with the stationary immobilizing/release means 80. More specifically, the outer radial positioning functional extreme portion 152, in the initial position, exceeds outside of the annular flange 30. The outer radial positioning functional extreme portion 152 bears against the finger 82 of the stationary immobilizing/release means 80, such that the finger 82 is moved against the urging of the spring 86 to no longer exceed outside of the tight connection device.

The container 20 comprises embedded locking/unlocking means 120 of the removable cover 28 on the annular flange 30.

These embedded locking/unlocking means 120—of which the structure is detailed below—have the function of ensuring the holding of the container 20 in these separate positions. The first position is qualified as an initial locking position as the locking/unlocking means 120 prevent the relative movement of the removable cover 28 with respect to the annular flange 30. The second position, qualified as the intermediate unlocking position, is intended to occur when the annular flange 30 of the container 20 is clamped axially against the peripheral wall 12 of the chamber 10 and allows the relative movement of the removable cover 28 with respect to the annular flange 30. The third position, qualified as the end locking position, is supposed to occur after the aseptic transfer of the biopharmaceutical products between the container 20 and the chamber 10 and prevents, again, the relative movement of the removable cover 28 with respect to the annular flange 30.

To ensure this switching from the initial locking position to the intermediate unlocking position, then to the end locking position, the embedded locking/unlocking means 120 comprise four embedded functional locking/unlocking arrangements 122 regularly distributed around the annular flange 28 of the cover 30.

Each embedded locking/unlocking functional arrangement 122 comprises a through housing 124 formed in the annular flange 30 as well as a blind housing 126 formed in the removable cover 28 of the container 20 and in the extension of the through housing 114.

Each embedded locking/unlocking functional arrangement 122 also comprises an inner radial positioning pin 128 and an outer radial positioning pin 130. These two inner 128 and outer 130 radially positioning pins have, according to the embodiment of FIGS. 3*a* and 5*a* to 5*c*, an extended body of cylindrical shape making it possible for them to be introduced and to be moved inside the blind housing 126 formed in the removable cover 28, on the one hand, and of the through housing 124 arranged in the annular flange 30, on the other hand. However, it must be noted that the dimensional features and the properties of the outer surface of these inner 128 and outer 130 radially positioning pins are such that the latter cannot be moved inside the blind 126 and through 124 housings, due to the single event of gravity. Furthermore, these inner 128 and outer 130 radially positioning pins could have a body of a different shape—for example, parallelepiped—in order to achieve the same result.

The through housing 124, the blind housing 126, the inner radial positioning pin 128 and the outer radial positioning pin 130 are coaxial and oriented in a radial direction relative to the annular flange 30. More precisely, according to this embodiment, these different elements extend along a substantially radial direction, oriented towards the geometric axis of revolution R. However, according to an alternative embodiment, said through housing 124, blind housing 126, inner radial positioning pin 128 and outer radial positioning pin 130 could also be oriented in a slightly inclined direction and forming an angle α with respect to a radial direction relative to the annular flange 30.

On the other hand, the blind housing 126 can be flush with the through housing 124, but it could also be considered to form an intermediate space between the blind housing 126 and the through housing 124 without this damaging the confinement and the handling of the container 20.

Figure 5A:
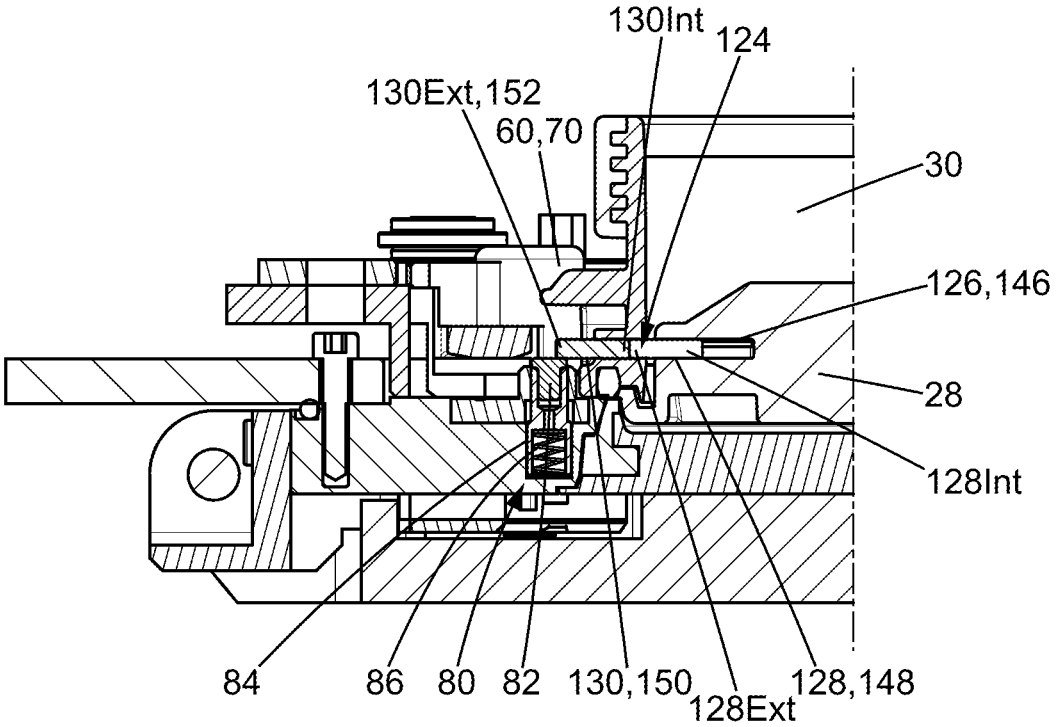
FIGS. 5*a* to 5*c* are transversal cross-sectional views of only one portion of the container associated with the tight connection device illustrating respectively an initial locking position, an intermediate unlocking position and an end locking position.

When the container 20 is located in the initial locking position, as illustrated by FIG. 5*a*, the inner radial positioning pin 128 has an inner initial locking functional portion $\mathbf{128}_{INT}$ arranged in the blind housing 126 of the removable cover 28 and an outer initial locking portion $\mathbf{128}_{EXT}$ arranged in the through housing 124 of the annular flange 30. Thus, the inner radial positioning pin 128 prevents the relative movement of the removable cover 28 with respect to the annular flange 30.

Moreover, in this same initial locking position, the outer radial positioning pin 130 is at least partially arranged in the through housing 124 of the annular flange 30. According to the embodiment represented in FIG. 5*a*, the outer radial positioning pin 130 can thus have an outer radial positioning functional extreme portion 130*ext* excluded from the through housing 124. Access to this functional extreme portion 130*ext* by the stationary unlocking 60 of locking 70 means is thus facilitated.

When the container 20 is located in the initial locking position, the outer radial positioning functional extreme portion 130*ext* of the outer radial positioning pin 130 abuts against the stationary immobilizing/release means, so as to switch them into a release position allowing a rotation of the annular functional crown 42.

More specifically, the outer radial positioning functional extreme portion 130*ext* of the outer radial positioning pin 130 bears against the finger 82 which is thus moved against the urging of the spring 86, to no longer exceeding outside of the connection device 40.

The container is thus allowed to switch into the intermediate unlocking position, the finger 82 of the stationary immobilizing/release means 80 no longer preventing the movement of the stationary unlocking means 60.

Figure 5B:
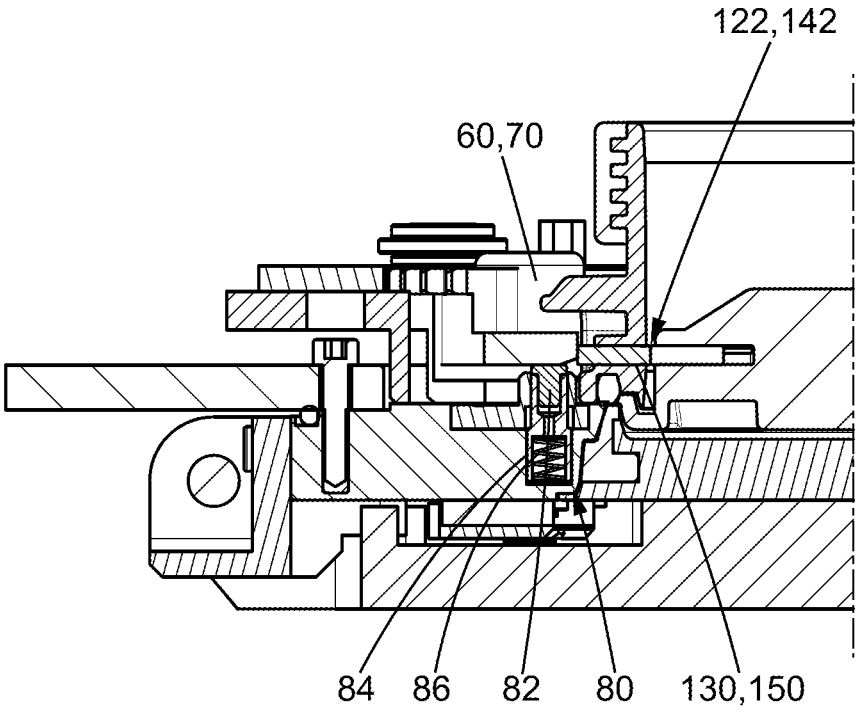

When the container 20 is located in the intermediate unlocking position, as illustrated by FIG. 5*b*, the inner radial positioning pin 128 is at least partially arranged in the blind housing 126 of the removable cover 28 and fully excluded from the through housing 124 of the annular flange 30. In this manner, this inner radial positioning pin 128 no longer prevents the relative movement of the removable cover 28 with respect to the annular flange 30.

In this intermediate unlocking position, still, the outer radial positioning pin 130 is at least partially arranged in the through housing 124 of the annular flange 30 and fully excluded from the blind housing 126 of the removable cover 28. In this manner, the outer radial positioning pin 130 has no more impact than the inner radial positioning pin 128 on the relative movement of the removable cover 28 with respect to the annular flange 30 which can therefore freely be disengaged to allow the aseptic transfer of the biopharmaceutical products.

Figure 5C:
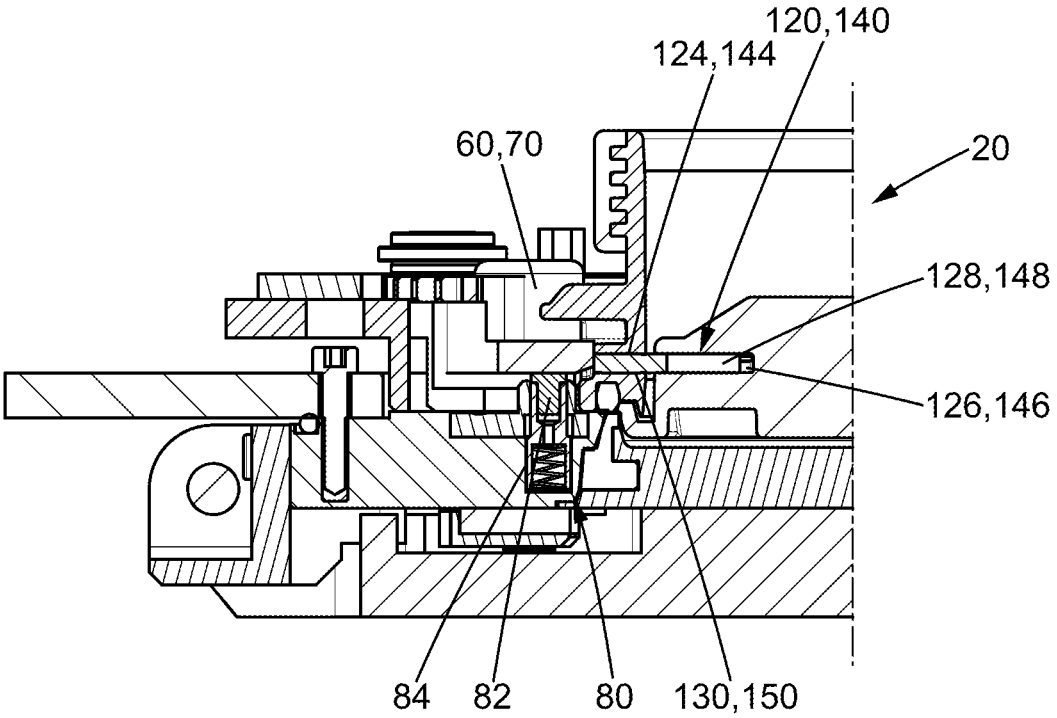

Finally, the place the container 20 in the end locking position, as illustrated by FIG. 5*c*, first the removable cover 28 must be replaced against the annular flange 30 then the embedded locking/unlocking functional arrangement 122 must be placed in the suitable position.

More specifically, in this position, the inner radial positioning pin 128 is fully arranged inside the blind housing 126 of the removable cover 28 while the outer radial positioning pin 130 has an inner end locking functional portion $\mathbf{130}_{INT}$ arranged in the blind housing 126 of the removable cover 28 and an outer end locking functional portion $\mathbf{130}_{EXT}$ arranged in the through housing 124 of the annular flange 30. Consequently, the blind housing 126 of the removable cover 28 has a sufficient length to receive, on the one hand, the inner radial positioning pin 128 and on the other hand, the inner end locking functional portion $\mathbf{130}_{INT}$. Thus, the outer radial positioning pin 130 prevents the relative movement of the removable cover 28 with respect to the annular flange 30.

Such a use of the inner 128 and outer 130 radial positioning pins to place the container in the initial locking, intermediate unlocking and end locking position makes it possible to only have one blind housing 126 and one through housing 124 to be produced in the removable cover 28 and the annular flange 30 by embedded locking/unlocking functional arrangement 122, which limits the risks of contamination linked to possible production defects. Furthermore, the handling of the locking/unlocking means 120 is facilitated insofar as it is sufficient to move the inner 128 and outer 130 radial positioning pins in one sole and single direction and one single and same direction to switch the container 20 successively from the initial locking position to the intermediate unlocking position, then to the end locking position. The embodiment and the functioning of the tight connection device are thus simplified from this.

In addition, once the outer radial positioning functional extreme portion 130*ext* is inserted in the through housing 124, to the end locking position, it becomes impossible to open the door of the chamber 10 with a container 20 already used. The risk of contamination is therefore thus highly decreased.

It must also be noted that in the embodiment of FIGS. 5*a* to 5*c*, the inner 128 and outer 130 radial positioning pins have identical lengths, which makes it possible, in particular, to simplify the production and the assembly of the inner 128 and outer 130 radial positioning pins on the container since it is thus not necessary to distinguish the pins as regards the respective dimensions thereof. However, alternatively, these inner 128 and outer 130 radial positioning pins could also have different lengths.

Furthermore, it must be underlined that the through housing 124 and the outer radial positioning pin 130 have lengths such that, when the embedded locking/unlocking means 110 are in the provisional unlocking position, the outer radial positioning pin 130 has an outer radial positioning functional extreme portion 130*ext* excluded from the through housing 124. This positioning facilitates, in particular, the operation carried out by the stationary locking means 70 to switch the container 20 from the intermediate unlocking position to the end locking position since the outer radial positioning pin 130 is accessible without the radial moving push-button element 78 not being moved inside the through housing 124.

However, the lengths of the outer radial positioning pin 130 and of the through housing 124 are such that, when the embedded locking/unlocking means 120 are in the end locking position, said outer radial positioning pin 130 has an outer radial positioning functional extreme portion 130*ext* housed inside the through housing. In this manner, when the container is placed in the end locking position, the gripping of the outer radial positioning pin 130 is made complex and unachievable without a suitable gripping tool. This thus makes it possible to increase the level of safety relating to the sealing of the container 20 in the end locking position.

According to an embodiment, the embedded immobilizing/release means 140 and the embedded locking/unlocking means 120 are structurally combined.

According to the embodiment of FIGS. 3*a* and 3*b*, the container 20 also comprises embedded partitioning and protective means 134.

The embedded partitioning and protective means 134 are arranged on an outer peripheral portion of the annular flange 30 so as to prevent the unexpected handling of the embedded locking/unlocking means carried by the annular flange 30.

The embedded partitioning and protective means 134 are, for example, chambers, at least partially or completely surrounding the through housings 124 so as to block the unexpected or voluntary handling of the outer radial positioning pin 130 when the latter is not fully inserted in the through housing 128 of the annular flange 30. There are as many embedded partitioning and protective means 134 as embedded locking/unlocking means 120 and/or embedded immobilizing/release means 140.

The implementation of the aseptic transfer method according to the invention is now described in detail.

This aseptic transfer method consists, firstly, of arranging a closed chamber 10 such as described above and supporting a tight connection device 40 according to the invention. This aseptic transfer method consists, secondly, of arranging a container 20 in the initial locking position such as described above.

The aseptic transfer method then involves implementing the container 20 against the peripheral wall 12 of the chamber 10 such that the pins belonging to the embedded locking/unlocking means face the stationary immobilizing/release means 80.

In doing this, the annular flange 30 of the container 20 is positioned against the peripheral wall 12 of the chamber 10 and the removable cover 28 for example, formed of magnetized stainless steel—is hermetically held in position against the outer face of the removable door 18—at least partially magnetized.

Simultaneously to this operation, the embedded immobilizing/release means 140 bear against the stationary immobilizing/release means 80 so as to allow the rotation of the annular functional crown 42.

According to a first embodiment, the aseptic transfer method then consists of generating the rotation of the annular functional crown 42 in order to actuate the stationary temporary clamping means 50. More specifically, the clamping element 52 rotate about the axis of rotation thereof so as to hold the container 20 against the chamber 10.

According to a second embodiment, the stationary clamping means 50 are actuated by the rotation of the protective crown 41. More specifically, a user actuates, for example, manually a lever 43 thus rotating the protective crown 41. The clamping element 52 thus rotate about the axis of rotation so as to hold the container 20 against the chamber 10.

Then, the rotation of the annular functional crown 42 makes it possible to actuate the stationary unlocking means 60. More specifically, the functional crown portions forming gearing drive the movement of the push-button elements 62 of the stationary unlocking means 60. Equal to the movement, the push-button elements 62 bear against the pins 128, 130, also moving them radially in the through and blind housings 124, 126.

From this operation, the inner radial positioning pin 128 is thus arranged in the blind housing 126 of the removable cover 28 and fully excluded from the through housing 124 of the annular flange 30 and the outer radial positioning pin 130 is arranged in the through housing 124 of the annular flange 30 and fully excluded from the blind housing 126 of the removable cover 28. Due to this, the container 20 is in the intermediate locking position and the relative movement of the removable cover 28 with respect to the annular flange 30 is possible.

The aseptic transfer method also consists, simultaneously or successively to the preceding step, of generating the rotation of the annular functional crown 42 in order to actuate the stationary opening means 90 to release the removable door 18 of the chamber 10.

To this end, the rotation of the unlocking means 60 drives the rotation of the functional rod 92 of the stationary opening means 90, and therefore of the body 94, such that the latter no longer covers the outer face of the removable door 18 of the chamber 10. The removable door 18 can thus be handled freely.

The aseptic transfer method thus consists of driving the stationary moving means 100 to move the removable door 18 of the chamber 10 and the removable cover of the container in order to release the annular openings 16, 26 of the chamber 10 and of the container 20.

To do this, the stationary moving means 100—which can be actuated by the annular functional crown 42 or by a moving motor subjugated on the position of this annular functional crown 42—rotate about an axis of rotation of a hinge, then, the removable door 18 of the chamber 10.

The container 20, being in the intermediate unlocking position, the removable cover 28 is capable of being moved with respect to the annular flange 30 and of following the movements of the removable door 18 of the chamber 10 due to the magnetic force connecting them to one another. Thus, the chamber 10 and the container 20 are open on one another while being hermetically isolated from the outside environment.

The aseptic transfer of biopharmaceutical products between the container 20 and the chamber 10 can thus be performed.

The aseptic transfer method then consists of again driving the stationary moving means 100 in order to hermetically close the annular openings 16, 26 of the chamber 10 and of the container 20.

As above, the stationary moving means 100 thus rotate, about an axis of rotation of a hinge, the removable door 18 of the chamber 10, as well as the removable cover of the container 20 to put them back into the same position as before.

The chamber 10 is thus again hermetically sealed by the removable door 18, as much with respect to the outside as with respect to the container 10, and, symmetrically, the container 20 is hermetically sealed by the removable cover, as much with respect to the outside as with respect to the chamber 10.

The aseptic transfer method thus consists of generating the rotation of the annular functional crown 42 in order to actuate the stationary opening means 90 to block the removable door 18 of the chamber 10.

To this end, the rotation of the unlocking means 60 rotates the functional rod 92 of the stationary opening means 90, and therefore of the body 94, such that the latter again covers the outer face of the removable door 18 of the chamber 10. The removable door 18 can thus be freely handled.

The aseptic transfer method consists, simultaneously or successively to the preceding step, of generating the rotation of the annular functional crown 42 in order to actuate the actuation of the stationary locking means 70. More specifically, the functional crown portions forming gearing drive the movement of the push-button elements 72 of the stationary locking means 70. Equal to the movement, the push-button elements 72 bear against the pins 128, 130, also moving them radially in the through and blind housings 124, 126.

From this operation, the inner radial positioning pin 128 is arranged in the blind housing 126 of the removable cover 28, while the outer radial positioning pin 130 has an inner end locking functional portion $\mathbf{130}_{INT}$ arranged in the blind housing 126 of the removable cover 28 and an outer end locking functional portion $\mathbf{130}_{EXT}$ arranged on the through housing 124 of the annular flange 30. Thus, the relative movement of the removable cover 28 with respect to the annular flange 30 is impossible and the container is thus in the end locking position.

The aseptic transfer method now consists of generating the rotation of the annular functional crown 42 such that the temporary clamping elements 52 return to the initial position thereof wherein the container 20 can be disengaged from the chamber 10.

According to a second embodiment, the stationary clamping means 50 are actuated by the rotation of the protective crown 41. More specifically, a user actuates, for example, manually a lever 43 thus rotating the protective crown 41. The clamping elements 52 thus rotate about the axis of rotation thereof so as to return to the initial position thereof wherein the container 20 can be disengaged from the chamber 10.

The container 20 in the end locking position can thus be freely removed from the tight connection device 40. The immobilizing/release means thus switch into a position wherein the rotation of the annular functional crown 42 is not allowed, so as to prevent the opening of the tight connection device without an unused container being engaged with it.

The invention claimed is:

1. A tight connection device to ensure the aseptic transfer of a biopharmaceutical product between a chamber equipped with a removable door and a container equipped with a removable cover, comprising:

a stationary temporary clamping means configured to hold the container against the chamber such that the removable cover of said container is hermetically pressed against the removable door of said chamber;

a stationary unlocking means for switching the container from an initial locking position wherein the removable cover hermetically seals the container to an intermediate unlocking position wherein the removable cover is disengaged from the container and hermetically held against the removable door of the chamber so as to ensure an aseptic communication between said container and said chamber;

a stationary locking means for switching the container from the intermediate unlocking position to an end locking position wherein said removable cover again hermetically seals the container;

an annular functional crown rotatable about a geometric axis of rotation so as to actuate the stationary unlocking means and the stationary locking means of the container, said stationary unlocking means and said stationary locking means being mechanically linked to the annular functional crown and arranged such that the rotation of said annular functional crown about the geometric axis of rotation successively drives the actuation of the stationary unlocking means ensuring the switching into the intermediate unlocking position of the container, then the actuation of the stationary locking means ensuring the switching into the end locking position of the container, and wherein the device further comprises stationary immobilizing/release means fixedly coupled to the chamber and configured to prevent rotation of the annular functional crown with the stationary immobilizing/release means in an immobilizing position, and to allow rotation of the annular functional crown with the stationary immobilizing/release means in a release position, wherein the stationary immobilizing/release means remains fixedly coupled to the chamber in the immobilizing position and in the release position.

2. The device according to claim 1, further comprising a stationary opening/closing means for preventing/allowing the opening of the removable door of the chamber and mechanically linked to the annular functional crown such that the rotation of the annular functional crown about the geometric axis of rotation successively or simultaneously drives the actuation of the stationary unlocking means ensuring the switching into the intermediate unlocking position of the container and the actuation of the stationary opening/closing means ensuring the release of the removable door of the chamber, wherein the actuation of the stationary locking means of the container ensures the switching into the end locking position of the container, and simultaneously or successively the actuation of the stationary opening/closing means ensures the immobilization of the removable door of the chamber.

3. The device according to claim 2, wherein the stationary opening/closing means are directly mechanically connected to an unlocking push-button element.

4. The device according to claim 2, wherein the stationary unlocking means comprise an unlocking push-button element with rotating movement and an unlocking member likely to be meshed by a portion of the annular functional crown forming gearing such that, during the rotation of the annular functional crown to an intermediate unlocking position, the push-button element is moved and switches the container from the initial locking position to the intermediate unlocking position.

5. The device according to claim 4, wherein the stationary locking means comprise a locking push-button element with rotating movement and a locking member likely to be meshed by a portion of the annular functional crown forming gearing such that, during the rotation of the annular functional crown to an end locking position, the push-button element is moved and switches the container from the intermediate unlocking position to the end locking position.

6. The device according to claim 1, wherein the stationary unlocking means comprise an unlocking push-button element with rotating movement and an unlocking member likely to be meshed by a portion of the annular functional crown forming gearing such that, during the rotation of the annular functional crown to an intermediate unlocking position, the push-button element is moved and switches the container from the initial locking position to the intermediate unlocking position.

7. The device according to claim 1, wherein the stationary locking means comprise a locking push-button element with rotating movement and a locking member likely to be meshed by a portion of the annular functional crown forming gearing such that, during the rotation of the annular functional crown to an end locking position, the push-button element is moved and switches the container from the intermediate unlocking position to the end locking position.

8. The device according to claim 1, wherein the stationary immobilizing/release means is configured to prevent rotation of a push-button element of the stationary unlocking means such that the container is not allowed to switch from an initial unlocking position to the intermediate unlocking position.

9. The device according to claim 1, wherein the stationary immobilizing/release means is configured to transition from the immobilizing position to the release position with the container held clamped against the chamber, by means of an embedded immobilizing/release means arranged on the container.

10. The device according to claim 1, wherein the stationary immobilizing/release means comprise a finger mounted mobile in a channel extending in a transversal direction to a radial direction, the finger being moveable by a spring to a deployed position wherein the finger extends outside of the tight connection device, and the stationary immobilizing/release means is in the immobilizing position, and to a retracted position wherein the finger does not extend outside of the tight connection device, and the stationary immobilizing/release means is in the release position.

11. The device according to claim 1, wherein the stationary temporary clamp comprise a clamping element configured to rotate about a clamping axis of rotation, such that, during the rotation of the annular functional crown to an initial locking position, the clamping element is moved and hermetically holds the container against the removable door of the chamber.

12. The device according to claim 1, wherein the stationary temporary clamp comprise a clamping element configured to rotate about a clamping axis of rotation, such that, during the activation of a lever resulting in the rotation of a protective crown, the clamping element is moved and hermetically holds the container against the removable door of the chamber.

13. The device according to claim 1, further comprising a stationary moving means of the removable door of the chamber for opening and hermetically closing the removable door of the chamber.

14. The device according to claim 13, wherein the stationary moving means of the removable door of the chamber moves the removable door of the chamber according to a rotating movement about a hinge axis, such that the door does not impede the switching of the biopharmaceutical product.

15. The device according to claim 1, wherein the annular functional crown is rotated by a lever.

16. The device according to claim 1, wherein the stationary locking means, as well as stationary unlocking means are at least two in number.

17. The device according to claim 1, wherein the stationary locking means and the stationary unlocking means are structurally combined.

18. An assembly comprising a chamber and a tight connection device associated with a container of single-use type equipped with a removable cover to facilitate the aseptic transfer of a biopharmaceutical product between the chamber and the container, wherein the chamber comprises a closed peripheral wall wherein an annular opening is arranged, hermetically sealed by a removable door and wherein the tight connection device is produced according to claim 1, the assembly further comprising a container of single-use type equipped with a removable cover.

19. The assembly according to claim 18, wherein the container of single-use type ensures the transport and the aseptic transfer of a product belonging to the biopharmaceutical field and comprises:

an annular flange delimiting an annular opening;

a removable cover capable of hermetically sealing the opening of the annular flange;

embedded immobilizing/release means of the annular functional crown;

embedded locking/unlocking means of the removable cover on the annular flange; and a peripheral casing integral with the annular flange and delimiting a confined inner space capable of receiving the products belonging to the biopharmaceutical field;

wherein the embedded immobilizing/release means comprise at least one embedded functional immobilizing/release arrangement formed by a through housing formed in the annular flange and a blind housing formed in the removable cover and in the extension of the through housing when the removable cover hermetically seals the opening of the annular flange and by an inner radial positioning pin and an outer radial positioning pin likely to be introduced and being moved inside the blind housing of the removable cover and of the through housing of the annular flange; and wherein the embedded immobilizing/release means comprise at least one embedded functional immobilizing/release arrangement formed by a through housing formed in the annular flange and a blind housing formed in the removable cover and in the extension of the through housing when the removable cover hermetically seals the opening of the annular flange and by an inner radial positioning pin and an outer radial positioning pin likely to be introduced and being moved inside the blind housing of the removable cover and of the through housing of the annular flange;

the container being in an initial locking position wherein, on the one hand, the inner radial positioning pin has an inner locking functional portion arranged in the blind housing of the removable cover and an outer locking functional portion arranged in the through housing of the annular flange so as to prevent the relative movement of the removable cover with respect to the annular flange and the outer radial positioning pin is at least partially arranged in the through housing of the annular flange, such that at least one initial outer functional locking portion of the outer radial positioning pin exceeds outside of the through housing;

the container being capable of being located in an intermediate unlocking position wherein, on the one hand, the inner radial positioning pin is at least partially arranged in the blind housing of the removable cover and fully excluded from the through housing of the annular flange and, on the other hand, the outer radial positioning pin is at least partially arranged in the through housing of the annular flange and fully excluded from the blind housing of the removable cover so as to allow the relative movement of the removable cover with respect to the annular flange; and the container being capable of being located in an end locking position wherein, on the one hand, the inner radial positioning pin is arranged in the blind housing of the removable cover and, on the other hand, the outer radial positioning pin has an end inner functional locking portion arranged in the blind housing of the removable cover and an end outer functional locking portion arranged in the through housing of the annular flange so as to prevent the relative movement of the removable cover with respect to the annular flange.

20. An aseptic transfer method intended to ensure the aseptic transfer of a biopharmaceutical product between a container and a chamber belonging to an assembly according to claim 18, wherein the method comprises successive steps comprising:

arranging the chamber, of the tight connection device and of the container;

positioning the container against the peripheral wall of the chamber by affixing the annular flange against the peripheral wall of the chamber, such that the stationary immobilizing/release means, and the embedded immobilizing/release means are face-to-face;

generating the clamping of the annular flange of the container with respect to the peripheral wall of the chamber;

switching the stationary immobilizing/release means from an immobilizing position to a release position;

generating the switching of the container from the initial locking position to the intermediate unlocking position by rotation of the annular functional crown;

simultaneously opening the removable door of the chamber and the removable cover of the container, the removable cover being hermetically fixed against the removable door;

aseptically transferring one or more biopharmaceutical products between the container and the chamber;

simultaneously closing the removable door of the chamber and the removable cover of the container, the removable cover being hermetically fixed against the removable door;

generating the switching of the container from the intermediate unlocking position to the end locking position by rotation of the annular functional crown;

generating the unclamping of the annular flange of the container with respect to the peripheral wall of the chamber; and switching the stationary immobilizing/release means from a release position to an immobilizing position.

* * * * *